US007104011B1

(12) United States Patent
Knight

(10) Patent No.: US 7,104,011 B1
(45) Date of Patent: Sep. 12, 2006

(54) RAIN GUTTER PROTECTION PANEL

(76) Inventor: Charles Knight, P.O. Box 568, Woodbury, NJ (US) 08096

( * ) Notice: Subject to any disclaimer, the term of this patent is extended or adjusted under 35 U.S.C. 154(b) by 50 days.

(21) Appl. No.: 10/641,898

(22) Filed: Aug. 15, 2003

(51) Int. Cl.
*E04D 13/064* (2006.01)
*E04D 13/04* (2006.01)

(52) U.S. Cl. ..... 52/12; 52/11

(58) Field of Classification Search ..... 52/12, 52/11, 16, 15, 102; 210/474, 163, 164; 4/510, 4/512; 248/48.1, 48.2
See application file for complete search history.

(56) References Cited

U.S. PATENT DOCUMENTS

| | | | | | |
|---|---|---|---|---|---|
| 3,023,544 | A * | 3/1962 | Hughes | 52/12 |
| 3,388,555 | A * | 6/1968 | Foster | 405/119 |
| 3,838,544 | A * | 10/1974 | Hindall | 52/60 |
| 3,950,951 | A * | 4/1976 | Zukauskas | 405/119 |
| 4,447,994 | A * | 5/1984 | Garneau | 52/11 |
| 4,604,837 | A * | 8/1986 | Beam | 52/12 |
| 4,616,450 | A * | 10/1986 | Shouse | 52/12 |
| 4,655,913 | A * | 4/1987 | Boersma | 210/163 |
| 4,799,713 | A * | 1/1989 | Uglow | 285/42 |
| 4,876,827 | A * | 10/1989 | Williams | 52/12 |
| 5,099,620 | A * | 3/1992 | Carey | 52/12 |
| 5,216,851 | A | 6/1993 | Kuhns | |
| 5,305,562 | A * | 4/1994 | Sapia | 52/12 |
| 5,339,575 | A | 8/1994 | Kuhns | |
| 5,383,310 | A * | 1/1995 | Sapia | 52/12 |
| 5,459,965 | A * | 10/1995 | Meckstroth | 52/12 |
| 5,471,798 | A * | 12/1995 | Kuhns | 52/12 |
| 5,640,809 | A * | 6/1997 | Iannelli | 52/12 |
| 5,729,931 | A * | 3/1998 | Wade | 52/12 |
| 5,842,311 | A * | 12/1998 | Morin | 52/12 |
| 6,016,631 | A * | 1/2000 | Lowrie, III | 52/12 |
| 6,073,398 | A * | 6/2000 | Williams | 52/12 |
| 6,151,836 | A * | 11/2000 | McGlothlin et al. | 52/11 |
| 6,161,338 | A * | 12/2000 | Kuhns | 52/12 |
| D470,926 | S | 2/2003 | Knight | |
| 6,536,165 | B1 * | 3/2003 | Pilcher | 52/12 |
| 2001/0017008 | A1 * | 8/2001 | Kuhns | 52/11 |
| 2001/0022052 | A1 * | 9/2001 | Pilcher | 52/14 |

FOREIGN PATENT DOCUMENTS

| | | | | |
|---|---|---|---|---|
| DE | 3523423 | * | 1/1987 | 210/163 |
| SE | 677947 | * | 7/1991 | 210/164 |

* cited by examiner

*Primary Examiner*—Lanna Mai
*Assistant Examiner*—Phi Dieu Tran A
(74) *Attorney, Agent, or Firm*—Norman E. Lehrer

(57) ABSTRACT

A protection panel for a rain gutter that includes a top planar surface, a wall which extends substantially vertically downwardly from the top, a curved lower portion, and a flange which extends outwardly and forwardly from the curved portion is disclosed. The wall includes a plurality of apertures arranged in one or more rows where the apertures are staggered. The flange has a right end, a left end, and a length extending therebetween where each of the ends is raised above the length of the flange so that a gap is formed between the flange and the rain gutter when the panel is secured under the forward lip of the rain gutter.

2 Claims, 2 Drawing Sheets

RAIN GUTTER PROTECTION PANEL

BACKGROUND OF THE INVENTION

The present invention is directed toward a rain gutter protection panel and more particularly, toward a panel that prevents water from overflowing the rain gutter and panel during heavy rains.

A common problem involved with covers used to prevent leaves, debris, and the like from clogging the rain gutter is that often rain water that bypasses the apertures formed in the cover and overflows the rain gutter. This is particularly true during unusually heavy rains.

For example, U.S. Pat. No. 3,388,555 to Foster discloses a gutter system which includes a trough with an outwardly convex portion and a plurality of apertures or openings located therein. Leaves and other debris are deflected away from the trough and do not enter the apertures while the water enters the trough through the apertures. During heavy rains, however, it may be possible with this system that some rain water may bypass the apertures, overflow the rain gutter and fall to the ground. In such a case, therefore, the rain gutter protection panel is not doing an effective job.

U.S. Pat. Nos. 5,216,851 and 5,339,575 to Kuhns disclose rain gutter covers which fit over existing rain gutters where the covers have a plurality of apertures in a substantially vertical wall through which water enters and passes into the gutter but through which leaves or other debris are unable to enter. The rain gutter covers of these patents also include a forwardly extending flange that fits under the upper forward lip of the gutter and is attached thereto by screws that pass downwardly through the gutter lip and into the flange. According to these patents, random openings are inherently formed between the lip and the flange so that rain water that gets passed the apertures hopefully will flow through these openings and into the gutter. These systems, however, can sometimes suffer from the same problems discussed above in that it may be possible that rain water bypass the apertures and the inherent openings and overflows the rain gutter. This is believed to result from the fact that the "inherent openings" are not formed or are too small or far between. This can occur by the installer utilizing too many screws and placing them too close together to form a substantial seal between the flange and the lip. Rain water, therefore, that bypasses the apertures has no where to go but over the lip of the gutter and on to the ground.

Therefore, a need exists for a rain gutter protection panel that collects substantially all of the rain water and prevents as much water as possible from overflowing the panel and the rain gutter.

SUMMARY OF THE INVENTION

The present invention is designed to overcome the deficiencies of the prior art discussed above. It is an object of the present invention to a rain gutter protection panel that collects substantially all of the rain water and water from overflowing the rain gutter.

In accordance with the illustrative embodiments demonstrating features and advantages of the present invention, there is provided a rain gutter protection panel that essentially includes a top planar surface, a wall extending substantially vertically downwardly from the top surface, and a flange extending outwardly and forwardly from the lower part of the wall. The wall includes at least one substantially horizontally extending row of apertures formed therein and a flap connected to the top of each aperture and extending downwardly and inwardly toward the inside of the panel to guide water into the gutter. The flange has a right end, a left end, and a length extending therebetween wherein each of the ends is raised so that a gap is formed between the flange and the rain gutter when the panel is secured to the rain gutter.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
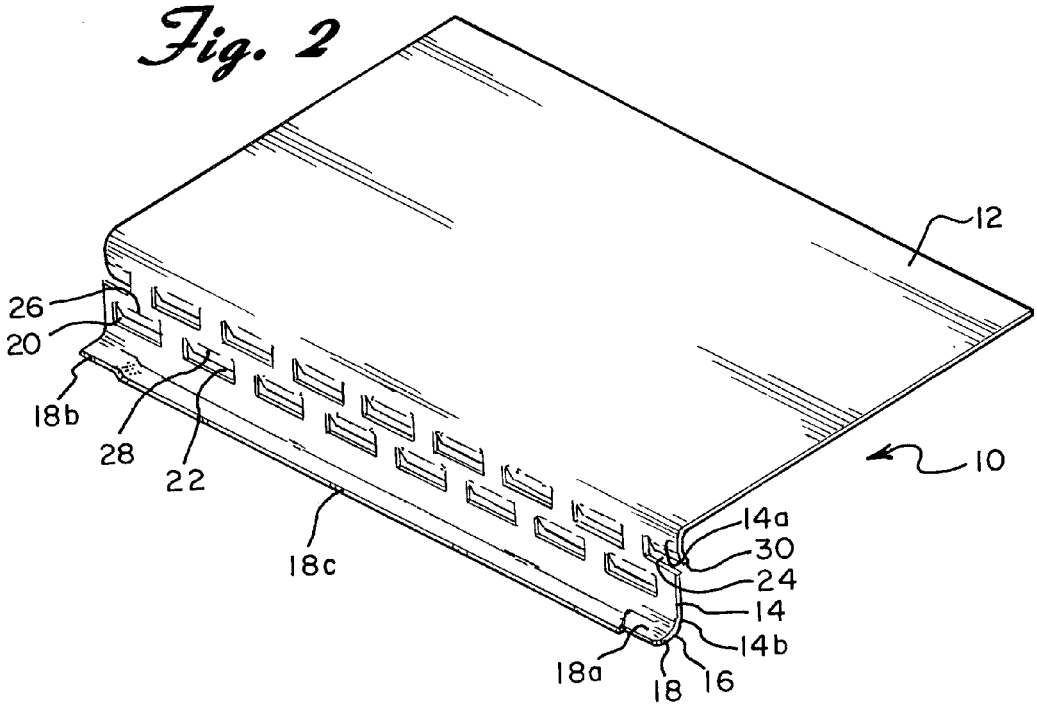
FIG. 2 is a front perspective view of the protection panel of the present invention prior to being installed on a gutter.

Referring now to the drawings in detail wherein like reference numerals have been used throughout the various figures to designate like elements, there is shown in FIG. 2 a gutter protection panel constructed in accordance with the principles of the present invention and designated generally as 10.

The rain gutter rain protection panel of the present invention essentially includes a top substantially planar surface 12 and a wall 14 extending substantially vertically downwardly from the top surface 12. The wall 14 has a top portion 14*a* and a bottom portion 14*b* and a curved portion 16 adjacent the bottom portion 14*a* of the wall 14. A horizontal flange 18 extends forwardly and outwardly from the curved portion 16. (See FIG. 2.)

Figure 1:
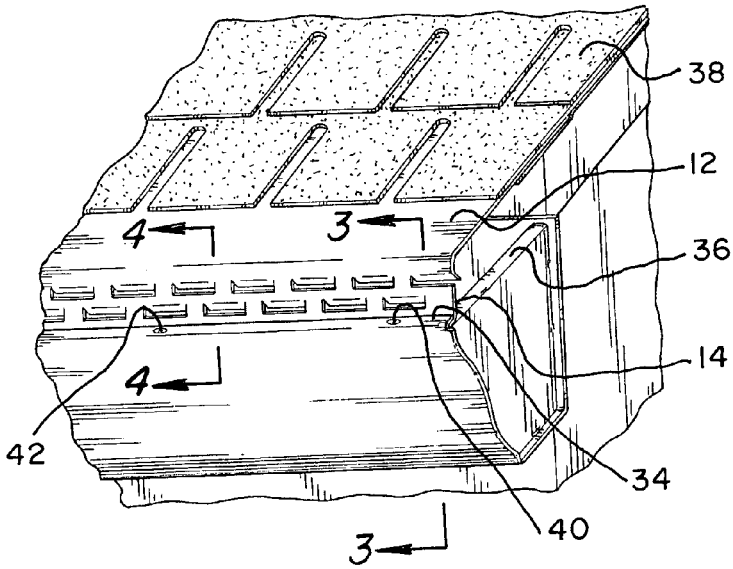
FIG. 1 is a front perspective view of the protection panel of the present invention installed on a rain gutter.
Figure 3:
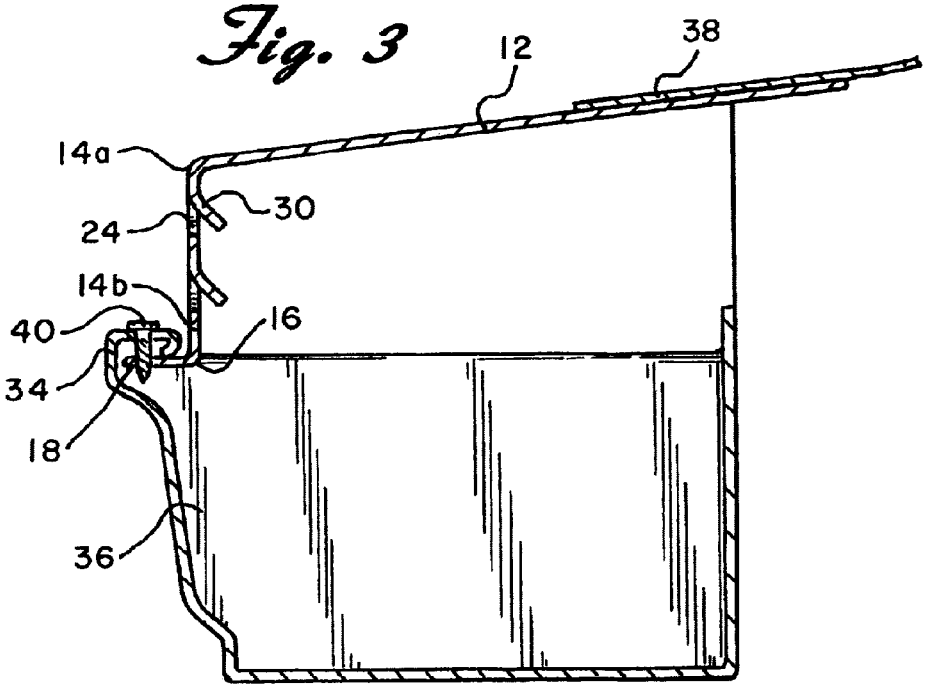
FIG. 3 is a cross-sectional view of the protection panel of the present invention taken through line 3—3 of FIG. 1.

The vertical wall 14 also has a plurality of substantially rectangularly shaped apertures or louvers 20, 22, and 24, for example, formed therein and arranged in a plurality of horizontal rows. The apertures in one row are staggered, or offset, from the apertures in the second row as shown in FIG. 1 and as is well known in the art. Extending from the top of each of the apertures 20, 22, and 24 is an inwardly extending substantially rectangularly shaped flap 26, 28, and 30, respectively. (See FIGS. 2 and 3.) The flap is smaller than the aperture so as leave a U-shaped cutout or opening therebetween.

The panel so far described is very similar to panels previously known and used in the art. See, for example, Gutter Protech panels sold by Absolute Gutter Protection, LLC of Woodbury, N.J. Furthermore, the manner in which such panels allow water to enter the gutter while rejecting leaves and other debris is also well known as described in the above mentioned patents. Accordingly it is not believed that a detailed description of the same is here necessary.

Figure 4:
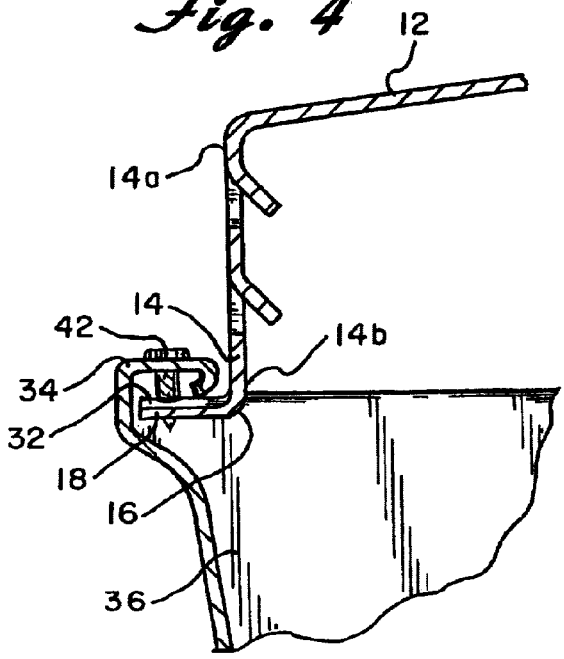
FIG. 4 is a cross-sectional view of the protection panel of the present invention taken through line 4—4 of FIG. 1.

The present invention, however, improves on preexisting panels. For example and as best shown in FIG. 2, the forwardly extending flange 18 of the present invention has a non-curvilinear right end 18*a* and a non-curvilinear left end 18*b* with a central length 18*c* extending therebetween. The ends 18*a* and 18*b* are raised slightly higher that the length 18*c* of the flange 18 so that a gap 32 is created between the central length 18*c* of flange 18 and the under surface of the lip 34 of the gutter 36 when the panel 10 is installed on the rain gutter, as will be described in greater detail below. (See FIG. 4.) This gap or opening 32 allows rain water that has bypassed the apertures to flow therethrough into the interior of the gutter rather than overflowing the gutter and falling to the ground. The size of the gap is preferably approximately 1/16 of an inch or less. The gap should be small enough to allow water to flow through but prevent debris from getting caught and collecting within the gutter.

A panel of the present invention is installed on a rain gutter by inserting the top surface 12 under the shingles 38 of the roof of a building. (See FIG. 1.) The flange 18 of the panel is placed under the lip 34 of the gutter 36 and is fastened or otherwise secured thereto via screws 40 and 42. The gap 32 is now formed between the lip 34 of the gutter 36 and the flange 18. (See FIG. 4.) Preferably the screws 40 at the ends 18*a* and 18*b* are inserted all of the way and are pulled tight so that the upper surface of the end 18*a* or 18*b* contacts the underside of the lip 34. Any intermediate screws 42, however, are preferably intentionally left loose so as to maintain the integrity of the gap 32.

The present invention may be embodied in other specific forms without departing from the spirit or essential attributes thereof and accordingly, references should be made to the appended claims rather than to the foregoing specification as indicating the scope of the invention.

I claim:

1. A rain gutter protection panel comprising a top substantially planar surface, a wall extending substantially vertically downwardly from said top surface, a flange extending outwardly and forwardly from the lower part of said wall, said wall including at least one substantially horizontally extending row of apertures formed in said wall and a flap connected to the top of each aperture and extending downwardly and inwardly toward the inside of the panel to guide water into the gutter, said flange having a non-curvilinear right end, a non-curvilinear left end, and a length extending therebetween wherein each of said ends is raised above said length of said flange so that a gap is adapted to be formed between said flange and the under surface of the lip of the rain gutter only along said length of said flange when the panel is secured to the under surface of the lip of the rain gutter.

2. The rain gutter protection panel as claimed in claim 1 wherein said wall includes a substantially horizontally extending second row of apertures formed therein with said second row of apertures horizontally offset from said first row of apertures.

* * * * *